United States Patent [19]

Bologna et al.

[11] 3,977,668

[45] Aug. 31, 1976

[54] DUAL PURPOSE SHEET MATERIAL FEEDING AND SAFETY APPARATUS

[75] Inventors: Vincent P. Bologna, Norwalk; Joseph E. McEvoy, Stamford, both of Conn.

[73] Assignee: Pitney-Bowes, Inc., Stamford, Conn.

[22] Filed: Sept. 26, 1975

[21] Appl. No.: 617,190

[52] U.S. Cl. ..... 271/126; 271/160; 271/165

[51] Int. Cl.[2] ..... B65H 1/06

[58] Field of Search ..... 271/126, 165, 166, 160, 271/37, 35, 124, 121, 167, 127, 131, 133, 138, 137, 23, 99, 94; 221/231; 214/8.5 H

[56] References Cited

UNITED STATES PATENTS

| | | | |
|---|---|---|---|
| 707,220 | 8/1902 | Eylar | 271/35 |
| 2,938,722 | 5/1960 | Luning | 271/165 X |

FOREIGN PATENTS OR APPLICATIONS

| | | | |
|---|---|---|---|
| 1,297 | 1/1890 | United Kingdom | 271/121 |

*Primary Examiner*—Evon C. Blunk
*Assistant Examiner*—Bruce H. Stoner, Jr.
*Attorney, Agent, or Firm*—William D. Soltow, Jr.; Albert W. Scribner; Robert S. Salzman

[57] ABSTRACT

A dual purpose sheet feeding and safety apparatus is described, which comprises a pivotable arm having a weighted member opposite the pivot end thereof. The weighted member rests upon and urges sheet material into the bite of a pair of feed rollers under the influence of gravity. When the sheet material has become depleted, the arm and weighted member pivot to a final rest position that has the weighted member covering the bite of the rollers. The weighted member now acts as a safety guard for protecting an operator's fingers or clothing from entering the roller bite.

1 Claim, 4 Drawing Figures

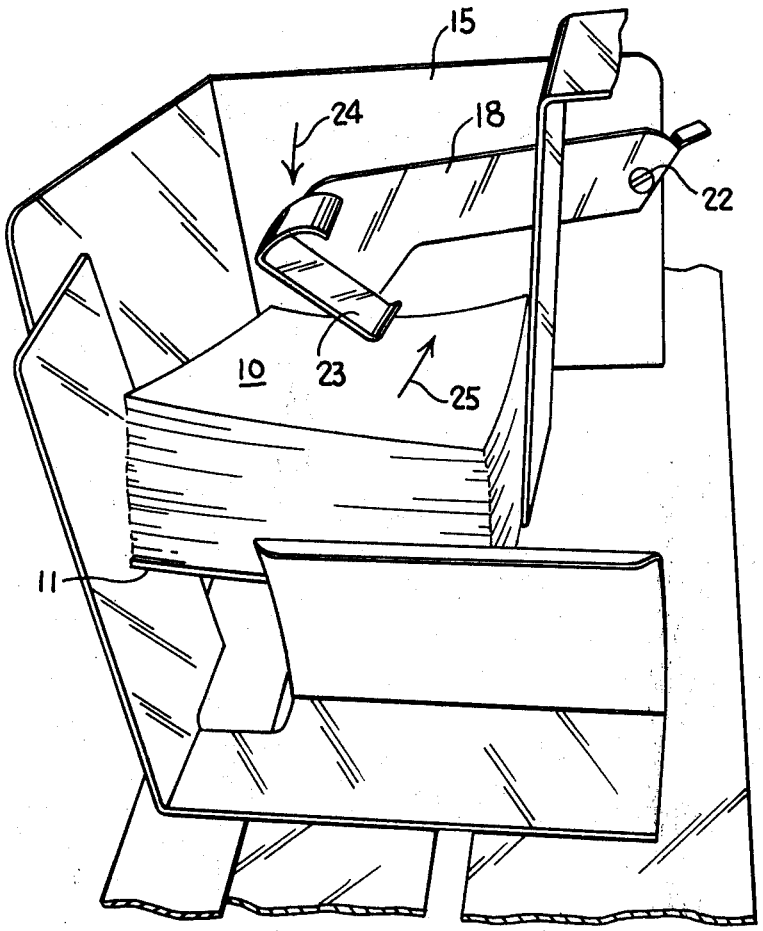
FIG. 1
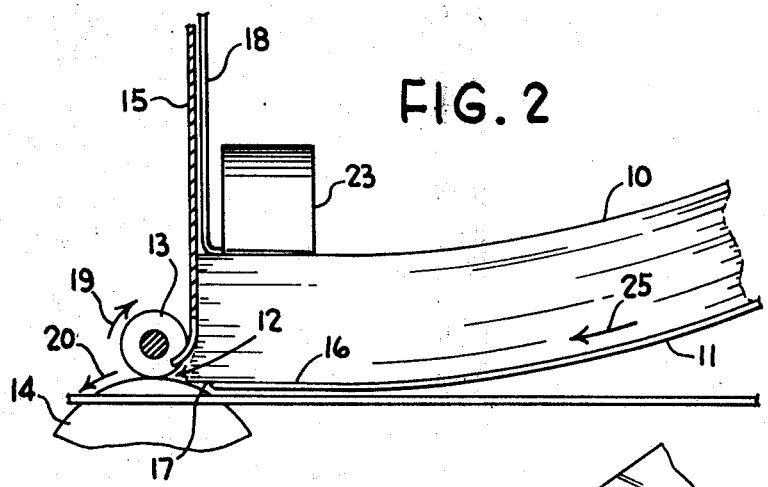
FIG. 2
FIG. 3
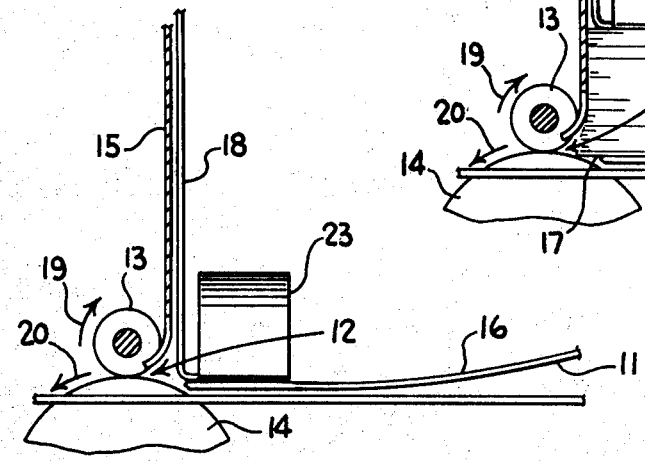
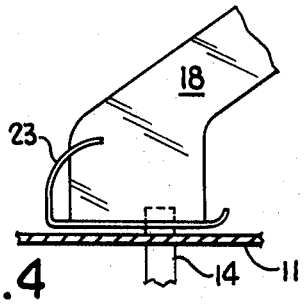
FIG. 4

DUAL PURPOSE SHEET MATERIAL FEEDING AND SAFETY APPARATUS

This invention relates to sheet feeding devices, and more particularly to a sheet feeding apparatus that has an automatic built-in safety function.

BACKGROUND OF THE INVENTION

In recent times, there has been a greater emphasis on product safety. In compliance with this trend, safety guards have been designed for protecting operators of machinery which feature moving parts.

The present invention is for a novel safety guard that has a dual purpose in that it not only protects the operator, but also plays a part in the machine's function.

SUMMARY OF THE INVENTION

The invention pertains to a dual purpose sheet material feeding and safety apparatus. This apparatus comprises a generally horizontal feeding deck that supports a stack of sheet material. The sheet material is fed from the stack to the bite of a pair of frictional feed rollers disposed at a junction formed between the deck and a vertically extending wall. One of the rollers of the pair partially extends above a surface portion of the deck so as to provide frictional contact with the sheet material. A pivotably mounted gravity arm is movably affixed to the vertical wall above the rollers. The arm is pivotable about one end, and gravity weighted about the other end opposite the pivot. The weighted end also forms a safety guard member. The guard member is raised above a stack of sheets disposed on the feeding deck, and then allowed to come to rest on the upper surface of the stack. The weighted guard member will then apply a force upon the stack to urge the sheets of the stack into frictional contact with the roller partially disposed above the deck. The weighted guard member gravitationally pivots the arm to a lower position as the stack becomes depleted. The guard member eventually comes to rest adjacent the pair of rollers, and covering the bite thereof. The guard member then acts as a protective safety guard against the inadvertent intrusion of an operator's fingers and/or his clothing (such as a tie) into the bite of the feed rollers.

It is an object of this invention to provide an improved safety guard for a sheet feeding apparatus;

It is another object of the invention to provide a dual purpose safety guard for a sheet feeding machine that also aids in the functioning of the feeding apparatus.

These and other objects of this invention will become more apparent and will be subject to a better understanding with reference to the following detailed description taken in conjunction with the accompanying drawing, in which:

FIG. 1 is a perspective view of the dual purpose sheet material feeding and safety apparatus of this invention;

FIG. 2 is a side view of FIG. 1;

FIG. 3 is a side view of FIG. 1 with the sheet material having been depleted from the feed deck; and FIG. 4 is a front view of FIG. 3.

Referring now to FIGS. 1 and 2, a stack 10 of sheet material is shown resting upon a generally horizontal feeding deck 11. The deck 11 has a slight incline as shown in FIG. 2 to gravitationally induce the feeding of the sheets of the stack towards (arrow 25) the bite (arrow 12) of a pair of rotating (arrows 19 and 20) conveying rollers 13 and 14, respectively.

A vertical wall 15 extends from the base of deck 11 and acts as a guide and a restraining abutment for the stack 10. The roller 14 extends slightly above the top surface 16 of deck 11, and frictionally engages with each bottom sheet 17 of the stack in seriatim fashion, until all the sheets of the stack are depleted.

A gravitationally movable pivot arm 18 is pivotably fixed to wall 15 about pivot 22. A weighted safety guard 23 is disposed on the other end of the arm 18 opposite pivot 22. The weighted safety guard 23 causes the arm to gravitationally pivot downwardly as shown by arrow 24 of FIG. 1.

OPERATION OF THE INVENTION

A stack 10 of sheet material is deposited upon feeding deck 11. Pivot arm 18 is raised above the top of the stack 10, and then allowed to drop (arrow 24) on top of the stack as shown in FIGS. 1 and 2. The weighted safety guard 23 puts a downward force on the stack, which urges the bottom sheet 17 (FIG. 2) into frictional engagement with rotating feed roller 14. This sheet is sucked into the bite 12 of the feed rollers 13 and 14, where it is discharged. Each successive bottom sheet in the stack is likewise fed to the pair of feeding rollers to be discharged from the deck 11.

The pivot arm 18 will progressively drop (pivot downwardly) as the stack 10 is depleted, due to the gravitational force exerted upon weighted member 23.

When the stack 10 is completely depleted, guard member 23 comes to rest adjacent the bite 12 of rollers 13 and 14, as shown in FIGS. 3 and 4. In this position, the guard 23 acts to protect the operator from inadvertently sticking his fingers into the rollers, or from sucking-in a piece of loose clothing such as the operator's tie.

Thus, it is seen that pivot arm 18 and guard 23 have the dual purpose of aiding the feeding of the sheet material, and acting as a guard once the material has been depleted.

Many modifications will naturally occur to the skilled practitioner in this art.

All modifications and changes of an obvious nature are deemed to lie within the spirit and scope of the invention as presented by the appended claim.

What is claimed is:

1. A dual purpose sheet material and safety apparatus, comprising:

a generally horizontal feeding deck for supporting a stack of sheet material;

a generally vertically extending wall disposed upon said feeding deck for guiding the sheet material;

a pair of frictional feed rollers generally disposed at a junction formed between the horizontal deck and the vertical wall, said feed rollers forming a bite for said sheet material for conveying the sheet material from said feeding deck, one of said pair of rollers partially extending above a surface portion of the deck so as to provide frictional contact with the sheet material; and a pivotably mounted gravity arm movably affixed to the vertical wall above said pair of feed rollers, said arm being pivotable about one end thereof, and having a weighted safety guard member on an end that is opposite to said pivotable end, said gravity arm being pivotable so as to be able to raise said guard member above the stack of sheets, the weighted guard member then coming to rest upon an upper surface of said stack, said weighted guard member then applying a force upon the stack to urge sheets of said stack into frictional contact with said partially extending roller, said safety guard member having the additional function of gravitationally pivoting the arm to a lower position as the stack becomes depleted, the guard member eventually coming to rest adjacent said pair of rollers and covering the bite thereof, said guard member then acting as a protective safety guard against the inadvertent intrusion of an operator's fingers and clothing into the bite of the feed rollers.

* * * * *